US006896583B2

(12) United States Patent
Rodriquez et al.

(10) Patent No.: US 6,896,583 B2
(45) Date of Patent: May 24, 2005

(54) METHOD AND APPARATUS FOR CONDITIONING A POLISHING PAD

(75) Inventors: Jose Omar Rodriquez, Orlando, FL (US); Laurence Darnell Schultz, Kissimmee, FL (US); Charles A. Storey, Orlando, FL (US)

(73) Assignee: Agere Systems, Inc., Allentown, PA (US)

( * ) Notice: Subject to any disclaimer, the term of this patent is extended or adjusted under 35 U.S.C. 154(b) by 609 days.

(21) Appl. No.: 09/731,402

(22) Filed: Feb. 6, 2001

(65) Prior Publication Data

US 2002/0106971 A1 Aug. 8, 2002

(51) Int. Cl.[7] ..... B24B 1/00

(52) U.S. Cl. ..... 451/5; 451/41; 451/56; 451/285

(58) Field of Search ..... 451/5, 8, 56, 41, 451/285, 287, 290, 9, 10, 286, 288, 289, 443, 444

(56) References Cited

U.S. PATENT DOCUMENTS 5,036,015 A 7/1991 Sandhu et al.
5,337,015 A 8/1994 Lustig et al.
5,595,527 A * 1/1997 Appel et al. ..... 451/28
5,639,388 A 6/1997 Kimura et al.
5,733,175 A 3/1998 Leach
5,743,784 A 4/1998 Birang et al.
5,860,847 A * 1/1999 Sakurai et al. ..... 451/10
5,904,608 A 5/1999 Watanabe
5,904,609 A 5/1999 Fukuroda et al.
5,944,590 A * 8/1999 Isobe et al. ..... 451/285
5,975,994 A * 11/1999 Sandhu et al. ..... 451/287
6,093,080 A 7/2000 Inaba et al.
6,306,008 B1 * 10/2001 Moore ..... 451/5

* cited by examiner

*Primary Examiner*—Lee D. Wilson
*Assistant Examiner*—Anthony Ojini

(57) ABSTRACT

A method (60) for conditioning a polishing pad (20) used for polishing semiconductor wafers (14). The degradation in conditioning performance of a conditioning device (28) is accounted for by controlling at least one of the conditioning velocity (64), conditioning down force (66) and conditioning time (68). The amount of the degradation of conditioning performance during consecutive uses of a conditioning device (28) may be determined by measuring the friction force (72) between the conditioning device (28) and the polishing pad (20), or it may be predicted on the basis of an algorithm (82) developed from data obtained from a plurality of representative conditioning devices (80).

11 Claims, 2 Drawing Sheets

METHOD AND APPARATUS FOR CONDITIONING A POLISHING PAD

BACKGROUND OF THE INVENTION

This invention relates generally to the field of polishing apparatus and methods, and more particularly, to a chemical mechanical polishing (CMP) pad conditioning process as may be used for the manufacture of semiconductor devices.

Modern semiconductor integrated circuits are formed on layers of various materials deposited on a semiconductor wafer substrate. After layers are deposited, portions of at least some of the layers are removed by various etching processes. These manufacturing steps may result in the topography of the in-process wafer being highly irregular at certain phases of the manufacturing sequence. Such irregularities may cause problems when depositing the next layer of the structure. For example, the photolithography equipment utilized to print a pattern defining various device geometries may have a very shallow depth of focus. Accordingly, it is necessary to have a flat wafer surface in order to ensure that all portions of the pattern are in proper focus. Accordingly, it is known to polish a semiconductor wafer utilizing a chemical mechanical polishing (CMP) process in order to achieve a planar surface. Such CMP processes typically involve rubbing the surface of the wafer against a polishing device to remove high spots on the wafer surface. The wafer is generally held in a stationary or rotating fixture while being pressed against a stationary or rotating polishing pad. The polishing pad is typically supported on a platen which may be rotated by an electric motor during the CMP process. The polishing surface of the polishing pad may be an open cell foam polyurethane or a sheet of polyurethane with a grooved surface. The polishing surface is relatively rough in comparison to the semiconductor wafer surface. A slurry of polishing fluid is often introduced to further aid in the chemical mechanical polishing process.

As with any polishing medium, the surface of the polishing pad will gradually become glazed due to the accumulation of material removed during the polishing process. Accordingly, the pad must be periodically conditioned to restore its rough surface texture. Such conditioning is known to involve the application of an abrasive surface of a conditioning device against the surface of the polishing pad to remove the accumulated debris and perhaps a portion of the polishing pad surface itself. Conditioning will expose a renewed polishing pad surface having characteristics essentially the same as a new pad. Typically, a polishing pad is conditioned after each semiconductor wafer is polished.

Several types of conditioning devices are known in the art. One such device is a conditioning disk having a diamond abrasive surface formed thereon. The abrasive surface is rubbed against the polishing pad surface at a predetermined velocity, for a predetermined length of time, with a predetermined amount of force exerted therebetween. The abrasive diamond surface functions to clean, roughen and condition the surface of the polishing pad. It is known that the amount of conditioning may be varied by changing the velocity, time of contact, or force between the conditioning device and the polishing pad. The amount of conditioning will increase with an increased velocity, a lengthened time period, or an increased force between the two surfaces.

It is important to control the amount of conditioning during a conditioning operation because either too much or too little conditioning will provide undesirable results. If too little conditioning is accomplished, the surface of the polishing pad will not have achieved the desired roughness value, and the subsequent planarization or polishing of a semiconductor wafer will have a less than optimal material removal rate. Conversely, if an excessive amount of conditioning is conducted, the life of the polishing pad is unnecessarily reduced and the time spent during the conditioning process is unnecessarily lengthened. U.S. Pat. No. 5,743,784 issued on Apr. 28, 1998, to Birang, et al. describes the use of a separate floating wafer device to determine the coefficient of friction of the polishing pad in order to determine an end point of a conditioning process. As the pad is conditioned, the coefficient of friction of the polishing pad will increase, thereby increasing the horizontal sliding force exerted between the floating wafer device and the polishing pad. By measuring this horizontal sliding force, an indirect indication of the degree of conditioning of the polishing pad is obtained. Thus, variables affecting the conditioning process may be controlled in order to achieve the desired degree or rate of conditioning. While the device and method of Birang are useful in controlling a conditioning process, the cost and size of the separate floating wafer device make it a less than optimal solution.

BRIEF SUMMARY OF THE INVENTION

Thus there is a particular need for an improved apparatus and method for controlling a conditioning process, and in particular, for taking into account the wear of a conditioning device abrasive surface between consecutive conditioning operations.

Accordingly, a method for conditioning a polishing pad is described herein to include the steps of: providing a conditioning device having an abrasive surface formed thereon; applying the abrasive surface of the conditioning device to a surface of a polishing pad at a selected velocity for a selected length of time while applying a selected compressive force therebetween; and controlling at least one of the selected velocity, the selected length of time and the selected compressive force in response to a signal corresponding to the friction force generated between the polishing pad and the conditioning device. The signal corresponding to the friction force is described in one embodiment as being a signal corresponding to the power supplied to a motor attached to the polishing pad. In a second embodiment, the signal corresponding to the friction force is described as being a signal corresponding to the deformation of a member connected to the conditioning device. The method may further include the step of generating the signal corresponding to the friction force in a signal generator programmed with an algorithm correlating a predicted change in the conditioning performance of the abrasive surface with an indicator of the amount of prior use of the abrasive surface. The method may further include the step of controlling the magnitude of the selected compressive force in response to a measurement of the current supplied to a motor attached to the polishing pad.

A method for conditioning a polishing pad used for polishing semiconductor wafers is further described herein as including the steps of: testing a plurality of conditioning devices having an abrasive surface formed thereon to develop an algorithm correlating a predicted change in the conditioning performance of a typical conditioning device to the amount of prior use of the conditioning device; providing a production conditioning device having an abrasive surface formed thereon; applying the abrasive surface of the production conditioning device to a surface of a polishing pad at a selected velocity for a selected length of time while applying a selected compressive force therebetween; and controlling at least one of the selected velocity, the selected length of time and the selected compressive force in accordance with the algorithm to maintain a consistent conditioning performance during consecutive uses of the production conditioning device.

An apparatus is described herein as including a polishing pad; a conditioning system adapted to apply an abrasive surface of a conditioning device to a surface of the polishing pad at a selected velocity for a selected length of time while applying a selected force therebetween; and a sensor for producing a first signal corresponding to the friction force generated between the polishing pad and the conditioning device. The conditioning system may include a controller having a first signal as an input, the conditioning system adapted to control at least one of the selected velocity, selected length of time and selected force in response to the first signal. The conditioning system may further include a motor for providing relative motion between the conditioning device and the polishing pad, and wherein the sensor may be an ampere meter adapted to produce the first signal responsive to an electrical current supplied to the motor. The conditioning system may further include an arm for positioning the conditioning device proximate the polishing pad, and wherein the sensor includes a strain gage adapted to produce the first signal responsive to a force exerted on the arm.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
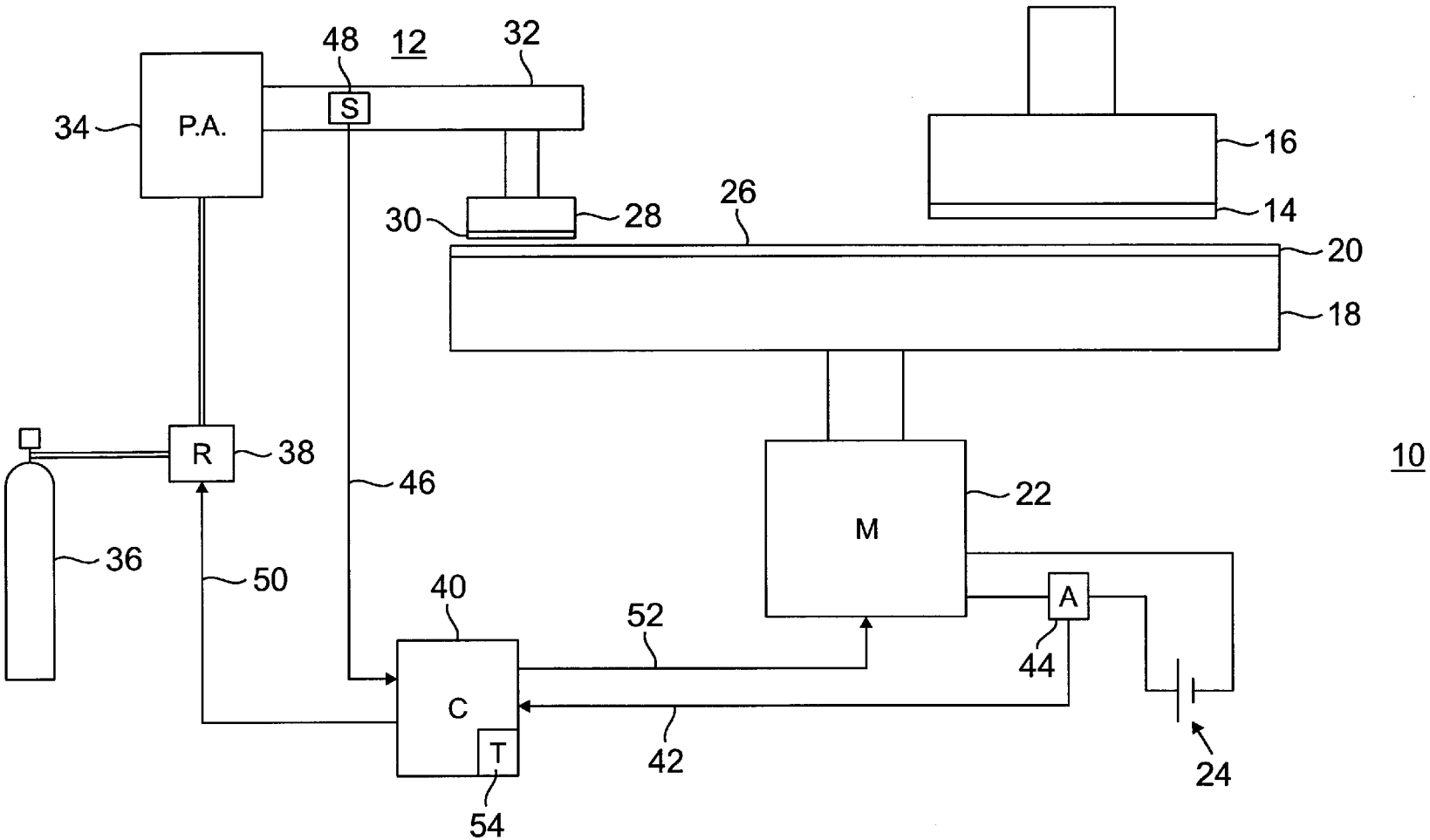
FIG. 1 is a schematic illustration of a semiconductor wafer polishing device including a conditioning device.

FIG. 1 illustrates a semiconductor wafer chemical mechanical polishing (CMP) device 10 including a conditioning system 12. A semiconductor wafer 14 is held in a stationary or rotating holder 16 which can be moved against a platen 18 covered with a polishing pad 20. The platen is rotated by a motor 22 connected to a power supply 24. The polishing surface 26 of the polishing pad 20 must be periodically conditioned to retain a desired level of roughness. To accomplish such conditioning, the conditioning system 12 includes a conditioning device 28 having an abrasive surface 30 which may be rubbed against the polishing surface 26 of polishing pad 20. Conditioning device 28 may further include an arm 32 for positioning the abrasive surface 30 proximate the polishing pad 20. Arm 32 is illustrated schematically as being connected to a pneumatic actuator 34 for providing horizontal and vertical movement of the conditioning device 28, as well as for providing a selected amount of force between the abrasive surface 30 and the polishing pad surface 26 during a conditioning operation. Pneumatic operator 34 is powered by a source of compressed gas 36 controlled by regulator 38. One may appreciate that the conditioning system 12 may have other embodiments, such as a device powered by electric motors, a device having a separately rotatable abrasive surface 30, an abrasive surface formed on a conditioning wheel, or other such variations as may be known in the art.

The conditioning performance of the conditioning system 12 will degrade as the abrasive surface 30 is used. The term conditioning performance is used herein to include any known measure of the amount or rate of conditioning accomplished on a polishing pad. For example, conditioning performance may be measured as a change in the roughness of the polishing pad, or the change in roughness of the polishing pad per unit of time. Alternatively, conditioning performance may be measured as the amount of material removed from a polishing pad, including debris materials and/or conditioning pad material. It is known that the conditioning performance of the conditioning device 28 is a function of the relative velocity between the abrasive surface 30 and the surface 26 of the polishing pad 20. It is also known that the conditioning performance is a function of the compressive force between these two surfaces, and a function of the length of time that the two surfaces remain in contact. Furthermore, the conditioning performance is a function of the roughness of the abrasive surface 30. The conditioning performance will increase as the velocity between the surfaces is increased, as the compressive force between the surfaces is increased, and as the length of time of contact between the surfaces is increased. It is also known that the conditioning performance will change as the amount of use of the conditioning device 28 is increased. For example, the rate of material removal from the surface 26 of the polishing pad 20 will decrease as the number of conditioning operations performed with a particular conditioning device 20 is increased. This decrease in conditioning performance is a function of the expected wear and glazing of the abrasive surface 30. A diamond abrasive surface 30 may clog with particles and/or the diamond particles may fall away from the surface or may become fractured.

It has now been found that the friction force generated between the conditioning device 28 and the polishing pad 20 will decrease as the number of uses of the conditioning device 28 increases, and that by measuring such friction force, an appropriate change may be made in other conditioning parameters in order to achieve a desired level of conditioning performance. As the conditioning performance degrades with use, a counterbalancing increase in conditioning performance may be induced by increasing the velocity between the respective surfaces 26, 30, by increasing the down force between these two surfaces, or by increasing the duration of the conditioning operation, thereby maintaining a substantially consistent conditioning performance during consecutive uses of a conditioning device. In this context, substantially consistent conditioning performance means that the appropriate variable, e.g. rate of material removal, total material removed, etc. will remain within a range of values small enough that the quality and performance of the end product are not adversely affected by the variation in conditioning performance between uses.

The polishing apparatus 10 and conditioning system 12 of FIG. 1 include a controller 40 adapted to control the conditioning performance in a manner sufficient to counteract the inherent decrease in conditioning performance of the conditioning device 24 over a number of consecutive uses. Controller 40 may be a microprocessor or any sort of electromechanical device known in the art for controlling a process. Controller 40 receives as an input a signal 42 from an ampere meter 44 associated with the power supply 24 and motor 22. Ampere meter 44 is adapted to measure the power being supplied to motor 22 and to produce a corresponding signal 42. One may appreciate that if motor 22 were powered by another energy source, such as a pneumatic motor powered by compressed gas, an appropriate equivalent sensor may be provided in lieu of ampere meter 44 for measuring the power or rate of energy delivery to such motor.

In addition to signal 42, or as an alternative thereto, controller 40 may receive an input signal 46 from a strain gage 48 attached to arm 32 or other structure connected to the conditioning device. Strain gage 48 is adapted to measure the deflection of arm 32 caused by the friction force generated between abrasive surface 30 and polishing pad surface 26. One may appreciate that both signals 42, 46 correspond in magnitude to the friction force generated between surfaces 26, 30. As the friction force increases, the amount of deflection of arm 32 will increase, and the amount of power that must be supplied to motor 22 in order to maintain a selected rotating speed will increase. Accordingly, as the conditioning performance of conditioning device 28 changes as a result of consecutive uses of abrasive surface 30, a corresponding change in signals 42, 46 will be realized.

In order to modify the conditioning process to account for a change in the conditioning performance caused by consecutive uses of abrasive surface 30, controller 40 may be programmed to provide signals necessary to control at least one of the velocity between surfaces 26, 30, the selected length of time of the conditioning operation, and the compressive force between the respective surfaces 26, 30. To accomplish such control, controller 40 may generate a control signal 50 connected to regulator 38 to control the amount of down force applied between the conditioning device 28 and the polishing pad 20 by pneumatic actuator 34. Controller 40 may also or alternatively provide a control signal 52 connected to motor 22 to control the speed of operation of motor 22. Furthermore, controller 40 may include an internal or external timer 54 associated with output signals 50, 52 for controlling the duration of the conditioning operation.

Figure 2:
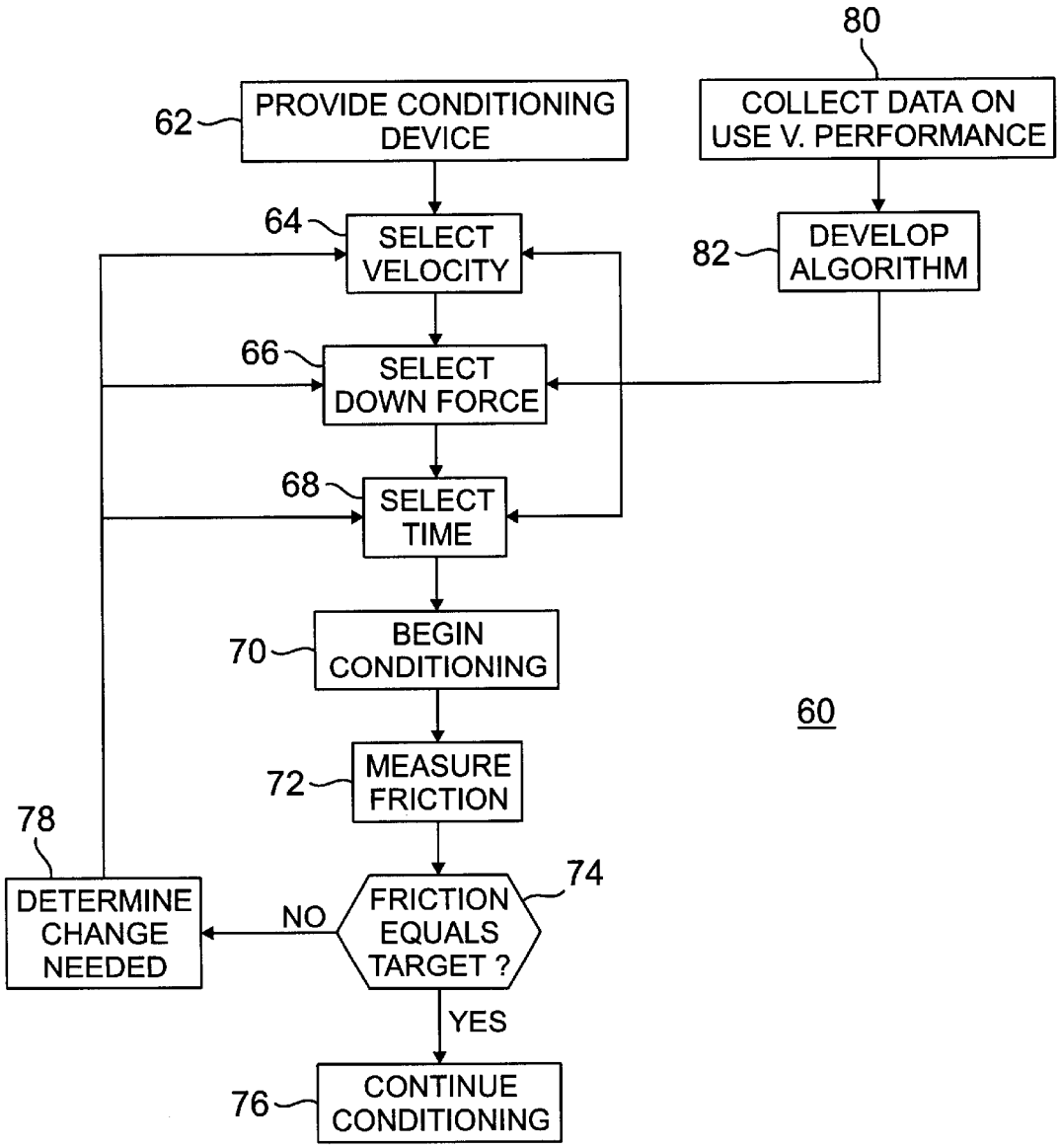
FIG. 2 illustrates the steps of a method for conditioning the polishing pad of a semiconductor wafer polishing apparatus.

FIG. 2 illustrates the steps of a method 60 for conditioning a polishing pad 20 used for polishing semiconductor wafers 14. A conditioning device, such as device 28 of FIG. 1, is provided at step 62. Conditioning parameters of velocity, down force and time are selected respectively at steps 64, 66, 68. A conditioning process is begun at step 70, and a measure of the friction between the conditioning device and the pad being conditioned is obtained at step 72. As described above, such measure of friction force may be obtained, for example, by measuring the amount of power supplied to a motor 22 or by measuring the amount of deformation of an arm 32 connected to the conditioning device 28. The measured amount of friction force is then compared to a target value at step 74. If the measured value of the friction force is within an acceptable range, the conditioning operation may continue to completion at step 76. If, however, the measured friction force differs from a target value by a predetermined amount, an appropriate change in the conditioning parameters may be determined at step 78. The friction force may be affected by changing at least one of the selected velocity of step 64, the selected down force at step 66, and the selected time at step 68. By controlling the friction force generated between the abrasive surface 30 and the surface 26 of the polishing pad 20 to a predetermined value or range, changes in the conditioning performance of the conditioning device 28 may be accounted for so that a desired amount of conditioning is accomplished during each conditioning operation. In this manner, problems associated with inadequate conditioning or with excessive conditioning may be avoided.

It may be desired to collect data at step 80 to determine the relations hip between the number of conditioning operations and the respective conditioning performance of a typical conditioning device. A plurality of typical conditioning devices may be tested over a representative number of conditioning operations to measure a typical or representative value for the degradation of conditioning performance as the abrasive surface 30 is used. It is possible to develop an algorithm at step 82 to correlate a predicted change in the conditioning performance of the abrasive surface of a conditioning device with the amount of prior use of that abrasive surface. The amount of prior use may be measured in terms of the number of conditioning operations, the length of time of conditioning operations, the amount of conditioning pad material removed by the conditioning device, or other such indicators of the amount of use of the abrasive surface. The algorithm developed at step 82 may be used directly to select the appropriate velocity, down force, and time at steps 64, 66, 68 prior to beginning the conditioning operation at step 70. In one embodiment, no further adjustment of the conditioning parameters may be necessary during a particular conditioning operation. In another embodiment, the actual friction generated during the conditioning operation may be measured at step 72, and further changes in at least one of the velocity, down force and time determined at step 78.

While the preferred embodiments of the present invention have been described herein, such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method for conditioning a polishing pad used for polishing semiconductor wafers, the method comprising the steps of:

providing a conditioning device having an abrasive surface formed thereon;

applying the abrasive surface of the conditioning device to a surface of a polishing pad at a selected velocity for a selected length of time while applying a selected force there between;

controlling at least one of the selected velocity, the selected length of time and the selected force in response to a signal corresponding to a friction force generated between the polishing pad and the conditioning device;

further comprising the step of obtaining the signal corresponding to the friction force by measuring the power supplied to a motor attached to the polishing pad.

2. A method for conditioning a polishing pad used for polishing semiconductor wafers, the method comprising the steps of:

providing a conditioning device having an abrasive surface formed thereon;

applying the abrasive surface of the conditioning device to a surface of a polishing pad at a selected velocity for a selected length of time while applying a selected force there between;

controlling at least one of the selected velocity, the selected length of time and the selected force in response to a signal corresponding to a friction force generated between the polishing pad and the conditioning device;

further comprising the step of obtaining the signal corresponding to the friction force by measuring the deformation of a member connected to the conditioning device.

3. A method for conditioning a polishing pad used for polishing semiconductor wafers, the method comprising the steps of:

providing a conditioning device having an abrasive surface formed thereon:

applying the abrasive surface of the conditioning device to a surface of a polishing pad at a selected velocity for a selected length of time while applying a selected force there between; and controlling at least one of the selected velocity, the selected length of time and the selected force in response to a signal corresponding to a friction force generated between the polishing pad and the conditioning device;

further comprising the step of generating the signal corresponding to the friction force in a signal generator programmed with an algorithm correlating a predicted change in the conditioning performance of the abrasive surface with an indicator of the amount of prior use of the abrasive surface.

4. A method for conditioning a polishing pad used for polishing semiconductor wafers, the method comprising the steps of:

providing a conditioning device having an abrasive surface formed thereon;

applying the abrasive surface of the conditioning device to a surface of a polishing pad at a selected velocity for a selected length of time while applying a selected force there between; and controlling at least one of the selected velocity, the selected length of time and the selected force in response to a signal corresponding to a friction force generated between the polishing pad and the conditioning device;

further comprising the step of controlling the magnitude of the selected force in response to a measurement of the current supplied to a motor attached to the polishing pad.

5. A method for conditioning a polishing pad used for polishing semiconductor wafers, the method comprising the steps of:

providing a conditioning device having an abrasive surface formed thereon;

rubbing the abrasive surface of the conditioning device against a surface of a polishing pad at a selected velocity for a selected length of time with a selected amount of force exerted there between; and controlling at least one of the selected velocity, the selected length of time and the selected force in response to a number of previous uses of the abrasive surface.

6. The method of claim 5 further comprising the step of controlling the selected velocity in response to a number of previous uses of the abrasive surface.

7. The method of claim 5, further comprising the step of controlling the selected length of time in response to a number of previous uses of the abrasive surface.

8. The method of claim 5, further comprising the step of controlling the selected force in response to a number of previous uses of the abrasive surface.

9. The method of claim 5, further comprising the step of testing a plurality of conditioning devices having an abrasive surface formed thereon to develop an algorithm correlating a predicted change in the conditioning performance of a typical conditioning device to an amount of prior use of the typical conditioning device.

10. The method of claim 9, further comprising selecting the algorithm to maintain a substantially consistent conditioning performance during consecutive uses of a production conditioning device.

11. A method for controlling the conditioning performance of a polishing pad used for polishing semiconductor wafers, the method comprising the steps of:

testing a plurality of conditioning devices having an abrasive surface formed thereon; and developing an algorithm based upon the testing to correlate a predicted change in the conditioning performance of a typical conditioning device to the amount of prior use of the conditioning device.

* * * * *